United States Patent [19]

Klostermann

[11] Patent Number: 4,884,292

[45] Date of Patent: Nov. 28, 1989

[54] AIR-COOLED X-RAY TUBE

[75] Inventor: Heinrich F. Klostermann, Menlo Park, Calif.

[73] Assignee: Medical Electronic Imaging Corporation, Fremont, Calif.

[21] Appl. No.: 879,598

[22] Filed: Jun. 27, 1986

Related U.S. Application Data

[63] Continuation-in-part of Ser. No. 326,752, Dec. 2, 1981, abandoned, which is a continuation-in-part of Ser. No. 90,501, Nov. 1, 1979, abandoned, which is a continuation-in-part of Ser. No. 71,192, Aug. 30, 1979, abandoned.

[51] Int. Cl.[4] ..... H05G 01/02; H01J 35/10

[52] U.S. Cl. ..... 378/127; 378/142; 378/199; 378/203

[58] Field of Search ..... 378/142, 141, 130, 129, 378/127, 203, 202, 199, 125, 194

[56] References Cited

U.S. PATENT DOCUMENTS

| | | | |
|---|---|---|---|
| 1,227,884 | 5/1917 | Caldwell | 378/199 |
| 2,049,275 | 7/1936 | Simon | 378/203 |
| 2,051,157 | 8/1936 | Van Vliet | 378/125 |
| 2,132,194 | 10/1938 | Skehan et al. | 378/202 |
| 2,222,549 | 11/1940 | Verhoeff | 378/130 |
| 2,345,723 | 4/1944 | Atlee et al. | 378/130 |
| 4,024,424 | 5/1977 | Eggelsmann et al. | 378/131 |
| 4,144,471 | 3/1979 | Hartl | 378/129 |
| 4,355,410 | 10/1982 | Sullins | 378/199 |

FOREIGN PATENT DOCUMENTS

| | | | |
|---|---|---|---|
| 656005 | 1/1938 | Fed. Rep. of Germany | 378/141 |

*Primary Examiner*—Craig E. Church
*Assistant Examiner*—T. N. Grigsby
*Attorney, Agent, or Firm*—Flehr, Hohbach, Test, Albritton & Herbert

[57] ABSTRACT

An X-ray tube generally comprises an evacuated tube envelope fabricated primarily of metal and having first and second end walls and a cylindrical sidewall, and encloses a rotating anode with its target surface facing the second end wall. A heat transfer sleeve extends from the first end wall past the anode to receive heat from the anode and transfer it to the end wall for dispersal. A heat transfer cross plate at the end of the sleeve further encloses the anode to receive and transfer heat. The tube envelope is mounted in a cylindrical tube housing with the first end wall in contact with a finned mounting plate for dissipating heat. The surface of the tube envelope remains sufficiently cool to apply a layer of lead, whereby the tube is compact. The anode and cathode electrical feeds are through the second end wall. The electrical feeds have angled terminations with lead on them.

21 Claims, 2 Drawing Sheets

FIG. 4
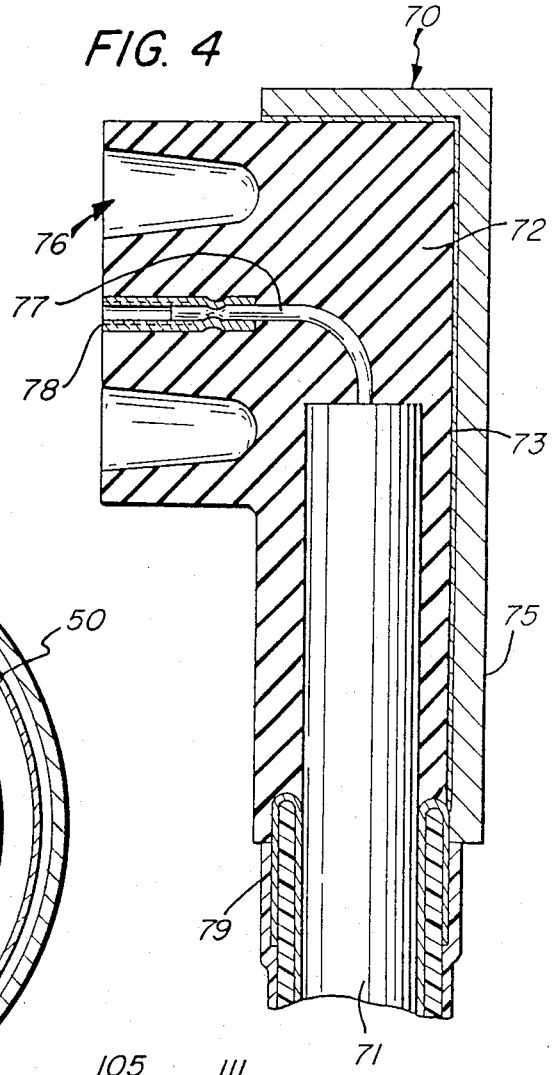
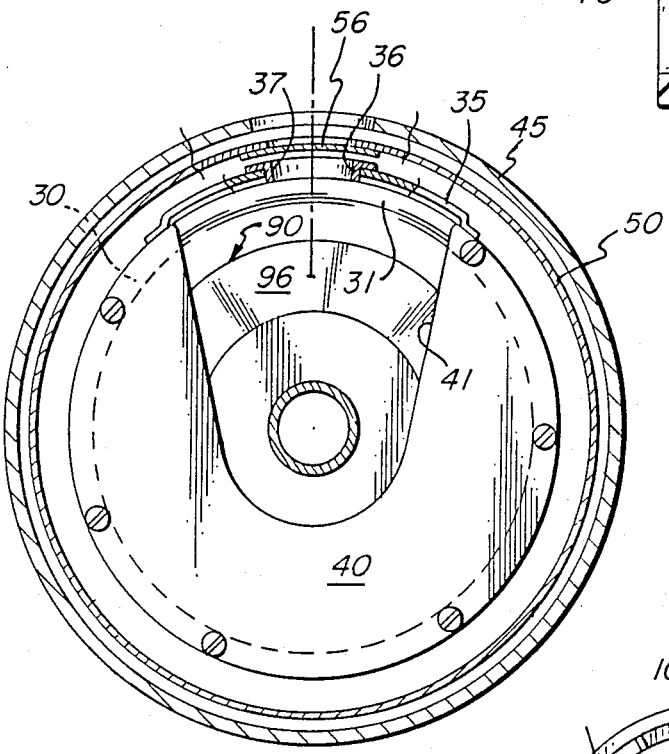
FIG. 3
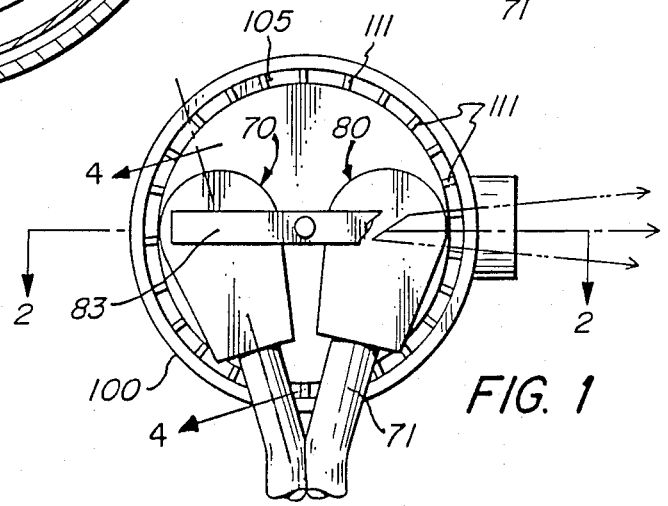
FIG. 1

AIR-COOLED X-RAY TUBE

This patent application is a continuation-in-part of my application Ser. No. 326,752, filed Dec. 2, 1981, abandoned, which was a continuation-in-part of my application Ser. No. 090,501 filed Nov. 1, 1979, abandoned which was a continuation-in-part of my application Ser. No. 071,192 filed Aug. 30, 1979 abandoned.

BACKGROUND OF INVENTION

This invention relates to an air-cooled X-ray tube with X-ray shielding material incorporated directly on the tube envelope.

High powered X-ray tubes, for example, those producing X-rays at voltages of 75 to 150 or more KV, develop a substantial amount of heat during operation. A rotating anode prevents damage to the anode itself during the high voltage, high temperature operation; however, the entire tube heats up and must be cooled in order to run continuously or frequently.

High powered X-ray tubes generally comprise a glass tube envelope in which an anode is rotatably mounted adjacent a cathode. The anode is mounted on a shaft with a rotor of an AC motor. The tube envelope is immersed in an oil bath for cooling purposes, providing good heat transfer from the tube envelope walls, and the oil may be circulated for cooling. The stator for driving the rotor and hence the anode is also located in the oil bath, surrounding the tube envelope and the rotor.

The oil bath method of cooling has many drawbacks. It increases the size and complexity of the overall X-ray tube apparatus, and creates difficulties in installing and replacing tubes. The oil must be contained in a sealed enclosure, and the entire oil bath container is generally shielded against loss of stray radiation.

SUMMARY OF THE INVENTION

It is a principal object of the invention herein to provide an air-cooled X-ray tube.

It is an additional object of the invention herein to provide an X-ray tube which is easy to install and replace.

It is a further object of the invention herein to provide an X-ray tube which is itself compact and which requires a minimum of external support systems.

It is yet another object of the invention herein to provide an X-ray tube with integral shielding against loss of stray radiation.

It is a further object of the invention herein to provide an X-ray tube which is capable of high power of operation.

It is also an object of the invention herein to provide an X-ray tube which is easy to assemble and to repair.

These and other objects and features of the invention herein will in part be obvious to those skilled in the art, will in part appear from a perusal of the following summary of the invention, drawings, description of the preferred embodiment and claims.

An X-ray tube according to the invention herein comprises a tube envelope fabricated primarily of metal and containing a rotatably mounted anode and a cathode. The tube envelope is generally cylindrical comprising first and second end plates connected by a cylindrical side wall. The first end plate is fabricated of a relatively large mass of material having a high thermal conductivity and is preferably provided means for transferring heat from its exterior surface. A cup accommodating the rotor extends from the end plate.

A heat transfer sleeve extends from the first end plate inside the tube adjacent but spaced from the cylindrical side wall. The heat transfer sleeve generally surrounds the anode. A heat transfer cross plate may be mounted on the end of the heat transfer sleeve, extending across the interior of the tube envelope and facing the target surface of the anode, with clearance for the anode shaft and cathode being provided as appropriate. The heat transfer sleeve and the heat transfer cross plate are preferably metal. The heat transfer sleeve and heat transfer cross plate receive radiant heat from the anode, and transfer the heat to the first end plate for dispersal. The heat transfer sleeve and heat transfer cross plate also shield the external side wall and second end plate of the tube from radiant heat, whereby the cylindrical side wall and end plate remain sufficiently cool to have lead X-ray shielding material applied directly thereon or closely adjacent thereto.

X-rays exit the tube through a window, with appropriate openings being provided in the heat transfer sleeve. In a preferred embodiment, the heat transfer sleeve is cut out in the vicinity of the cathode and window, and an auxiliary shield including an off axis shield is provided in this area.

The other second end plate mounts cathode and anode feed-throughs, which are fabricated of ceramic. Cables providing power to the anode and cathode have an angled termination adjacent to the second end plate, and the terminations and end plate are provided with lead shielding to complete shielding of the tube envelope. The angle of the termination prevents the escape of stray X-rays.

The X-ray tube envelope is mounted in a cylindrical tube housing which acts as a heatsink and forms an air passage surrounding the tube envelope. The tube housing preferably includes a finned mounting plate mechanically and thermally connected to the first end wall of the tube envelope, to dissipate heat from the end wall. The fins are also mechanically thermally connected to the cylindrical exterior wall of the tube housing, which provides additional surface area for dissipating heat. A fan is deployed to blow air against the finned tube mounting plate and thus against the heat-dispersing first end wall, and around the remainder of the tube. The tube housing may also mount the stator for driving the rotor and anode.

The invention herein will be more fully understood with reference to the following description of the preferred embodiments and the drawings.

DRAWINGS

FIG. 1 is an end view of an X-ray tube assembly according to the invention herein looking in the direction of line 1—1 of FIG. 2, showing the angled cable terminations;

FIG. 3 is a cross sectional view of the X-ray tube of FIG. 2 taken along the lines 3—3 of FIG. 2; and FIG. 4 is a sectional view of a cable termination for the X-ray tube taken along the line 4—4 of FIG. 1.

The same reference numerals refer to the same elements throughout the various figures.

DESCRIPTION OF PREFERRED EMBODIMENT

Figure 2:
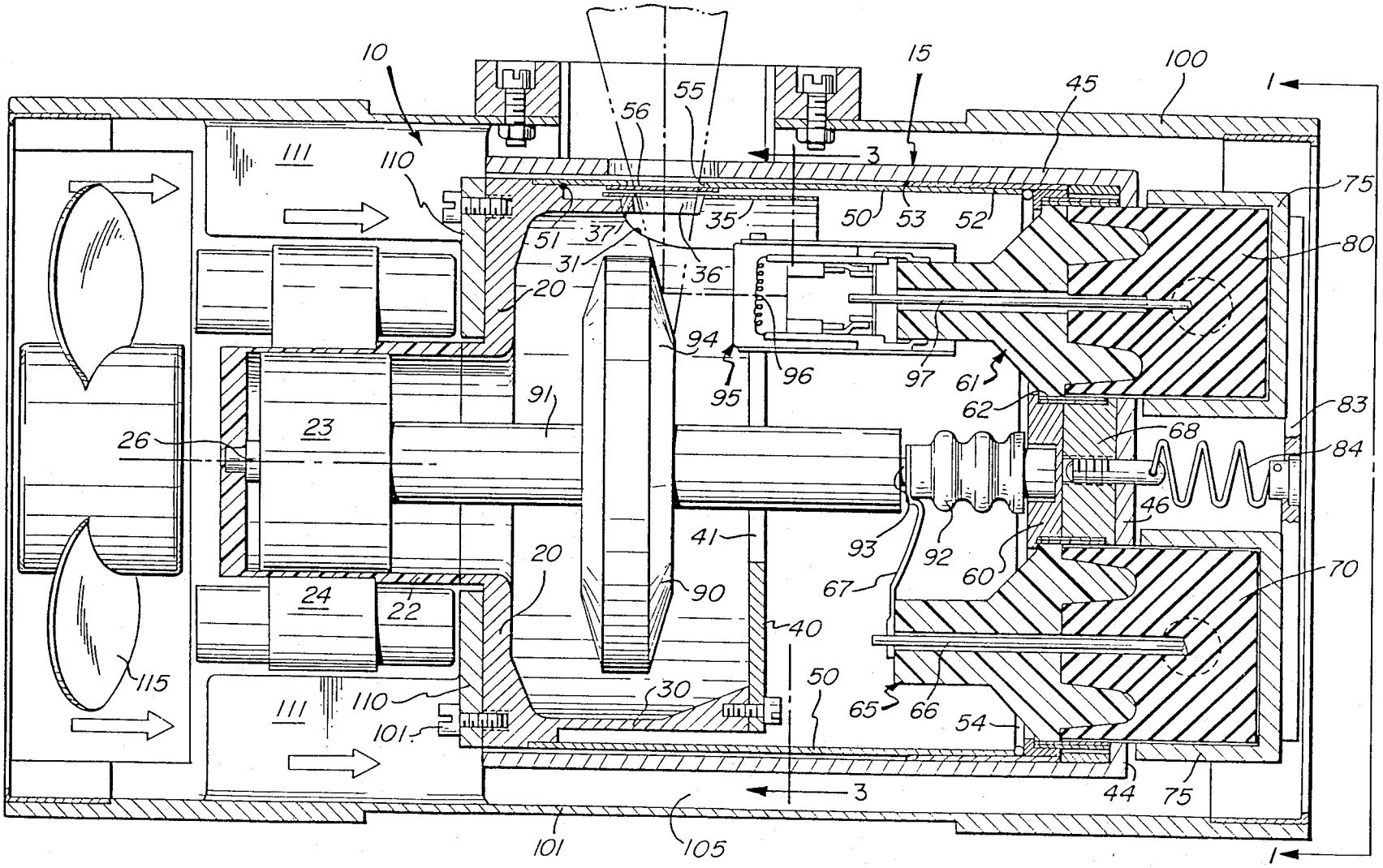
FIG. 2 is a longitudinal sectional view of the X-ray tube taken along the line 2—2 of FIG. 1.

My previous applications identified above are hereby incorporated herein by reference.

FIGS. 1–3 illustrate an air-cooled X-ray tube 10 in a tube housing 100 according to the invention herein. The X-ray tube 10 is of the rotating anode type, having a rotatable anode 90 and a cathode 95 enclosed therein for producing X-rays.

The X-ray tube 10 comprises a tube envelope 15 having a first end wall 20, a cylindrical side wall 50 and a second end wall 60. The tube is characterized by a heat transfer sleeve 30 extending from the first end wall 20 and surrounding the anode 90.

The first end wall 20 is fabricated of a material having a high heat conductivity, which may be a cromium copper alloy. The end wall 20, and thus the tube, is mounted onto the finned mounting plate 110 of the tube housing; thus the housing acts as a large heatsink and heat dissipator. The end wall 20 also mounts a protruding cylindrical cup 22, the interior of which accommodates a rotor 23 secured to shaft 91 on which anode 90 is carried. The cup 22 also mounts the bearing assembly 26 for one end of shaft 91. Deployed about the exterior of cup 22 is a stator 24, and the rotor 23 and stator 24 together comprise a motor for rotating the anode 90. The target surface 94 of the anode faces the second end wall 60.

The cylindrical side wall 50 is brazed to the end wall 20 at 51, and the side wall extends toward the second end wall 60. In the preferred embodiment shown, a second concentric cylindrical sleeve 52 is brazed to the end wall 60, and closely fit over the cylindrical side wall 50, with side wall 50 and sleeve 52 being welded together at 53. A spacer ring 54 may be positioned between the end of side wall 50 and the end wall 60, if desired.

Ceramic insulators 61 and 65 are mounted through and vacuum sealed to the end plate 60. The mounting and sealing is accomplished by use of concentric metal rings, the inside one of which is brazed to the ceramic insulator, the outside one of which is welded to the end plate and the pair of which are brazed together. This is known in the art and is generally indicated at 62. The ceramic insulator 61 mounts the cathode 95 including the cathode filament 96, and a conductor 97 extends through the ceramic 61 providing an electrical connection from outside the tube envelope to the cathode filament 96. Ceramic insulator 65 passes a conductor 66 which is connected from its interior end to shaft 91 by lead 67, for making electrical connection with the anode 90. The end wall 60 also conveniently mounts the second end of shaft 91, on an insulator 92 and bearing assembly 93.

The X-ray tube 10 further comprises the heat transfer sleeve 30, which extends from the end plate 20 inwardly to substantially surround the anode 90. The heat transfer sleeve 30 is made of a material having a high heat conductivity such as chromium copper. It may, if desired, be fabricated as an integral part with the end plate 20, but if it is a separate piece attached thereto, it has sufficient interface with end plate 20 to achieve good heat transfer. In the embodiment shown, the heat transfer sleeve 30 has a cut-out portion, generally indicated at 31 and best seen in FIGS. 2 and 3, the cut-out portion providing electrical and mechanical clearance for the cathode assembly 95. A supplementary shield 35 is mounted to cover the cut-out portion 31, and the shield 35 includes an opening 36 for passing the desired beam of X-rays. The auxiliary shield 35 may be fabricated of molybdenum, and may include a thick annular ring 37 surrounding the opening 36 as a shield against off-axis radiation. The cylindrical side wall 50 is also provided with a window opening at 55, which may be covered by the plate 56 which is relatively X-ray transparent or may comprise merely a thin portion of the cylindrical side wall 55. The molybdenum from which the auxiliary shield 35 is fabricated also has a relatively high thermal conductivity.

A heat transfer plate 40 is preferably secured to the inner end of the heat transfer sleeve 30, again as best seen in FIGS. 2 and 3. The heat transfer plate 40 has a notch 41 cut-out to provide clearance for the shaft 91 and the cathode assembly 95 (the cathode assembly 95 not being shown in FIG. 3).

When the X-ray tube 10 is in operation producing X-rays, the anode becomes quite hot. The heat transfer sleeve and heat transfer plate receive radiant heat from the anode and transfer it to the end plate 20, for dispersal to the outside air. A substantial portion of the heat is transferred from the end plate 20 to the finned tube mounting plate 110, for dispersal. Thus, the X-ray tube 10 according to the invention remains relatively cool in operation. The arrangement of the heat transfer sleeve 30 and heat transfer plate 40 shield the exterior cylindrical wall 50 and the second end plate 60 from the heat radiating from the anode, maintaining these parts sufficiently cool that a coating or layer 45, 46 of lead or other X-ray absorptive material may be applied directly on the exterior of the tube without having it soften or melt during tube operation. The lead layer 45 covers the cylindrical side wall 50 (except for the window 55) and lead layer 46 covers the end wall 60 (except for the exposed portions of insulators 61 and 65). It is not necessary to cover end wall 20, which is protected by the anode itself.

The cable terminations used with the X-ray tube 10 also employ the feature of applying lead directly to the exterior of the tube for shielding against stray radiation, which is achieved by utilizing angled terminations. Terminations 70 and 80 for the anode and cathode, respectively, are shown in FIGS. 1 and 2, and FIG. 4 shows a sectional view of termination 70 alone. With reference to FIGS. 1 and 4, the terminal end of the anode supply cable 71 is encapsulated in a formed insulating compound 72, which may be a polyvinyl chloride or the like. The insulating compound 72 is surrounded by a metallic outer shell 73, which is in turn covered with a lead coating 75. A face surface 76 of the insulating compound 72 is shaped to matingly conform with the ceramic insulator 65, as best seen in FIG. 2. Referring again to FIG. 4, the conductor 77 of the anode supply cable 71 extends beyond the cable insulation and is bent at right angles and terminated in a hollow pin 78 for making electrical connection with the conductor 66 extending through the ceramic insulator 65. The braid 79 of the cable 71 is folded back from the cable insulation but makes contact with the stainless steel shell 73.

The main feature of the termination is the angle achieved between the supply cable 71 as it enters the termination 70, and the end plate of the tube envelope together with the lead coating 75. The angle is such that any stray radiation exiting the tube envelope through the ceramic insulator 65 cannot escape along the cable, as it could if the termination were not angled, but will be blocked by the lead shield.

The cathode termination is similar, although it will be appreciated that the cathode supply cable will have several conductors for a multi-filament cathode assembly. The terminations 70 and 80 are fitted onto the ceramic insulators 61 and 65, and are held in position by a mounting bar 83 and by a spring 84.

The end plate 60 is provided with a spacer 68, which accommodates the concentric ring seals 62 between the ceramic insulators and the end wall, and the lead coating 46 is applied over the spacer 68. With reference to FIG. 2, the lead coating 45 of the cylindrical side wall 50 is folded in at 44 over the end plate, and the lead coating 75 of the termination 70 is positioned adjacent thereto, such that radiation can not escape.

The X-ray tube 10 is mounted in a cylindrical tube housing 100 on a finned mounting plate 110 by means of axially extending mounting screws 101. The fins 111 of the finned mounting plate 110 are connected to the outer cylindrical wall of the tube housing, which mechanically supports the mounting plate 110 and also provides for heat transfer to the outer cylindrical wall, for additional heat dissipation and an air passage 105 is formed between the cylindrical side wall 50 of the tube envelope 15 and the tube housing 100. The mounting plate 110 is discontinuous at its periphery, to also define the air passage 105. A fan 115 is mounted at one end of the tube housing 100 to direct air onto the end finned mounting plate 110 and particularly its fins 111, and to drive air through the passage 105, thereby cooling the tube.

Accordingly, there has been described the X-ray tube which is adapted for air-cooled operation, thereby admirably achieving the objects of the invention herein. It will be appreciated that various changes may be made from the preferred embodiment herein without departing from the spirit and scope of the invention, which is limited only by the following claims.

I claim:

1. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying electrical potential to produce x-rays;

(D) a heat transfer sleeve within said evacuated tube envelope extending from the first end wall toward the second end wall and beyond the anode and having a free end, the heat transfer sleeve being spaced-apart from the cylindrical side wall of the tube envelope and being disposed exteriorally of the anode to provide an annular vacuum space, the heat transfer sleeve receiving heat emanating from the anode during operation of the tube to produce X-rays and transferring that heat to the first end wall for dispersal, the heat transfer sleeve and cylindrical side wall of the tube envelope including means permitting the passage therethrough of the desired beam of X-rays from within the tube envelope and exteriorally of the tube envelope; and (E) air-cooled means for cooling said first end wall.

2. An X-ray tube as defined in claim 1 and further comprising a layer of X-ray absorbing material closely surrounding the exterior of the cylindrical side wall and second end wall, except for an area for passing a desired beam of X-rays.

3. An X-ray tube as defined in claim 2 wherein the X-ray absorbing material is lead.

4. An X-ray tube as defined in claim 1 and further comprising:

(E) heat transfer cross plate secured to the free end of the heat transfer sleeve and extending substantially across the target face of the anode, the heat transfer cross plate receiving heat emanating from the anode during operation of the X-ray tube to produce X-rays, and transferring that heat via the heat transfer sleeve to the first end wall for dispersal.

5. An X-ray tube as defined in claim 4 and further comprising a layer of radiation absorbing material applied to the exterior of the cylindrical side wall and second end wall, except for an area for passing a desired beam of X-rays.

6. An X-ray tube as defined in claim 1 and further comprising:

(F) a cylindrical tube housing surrounding and spaced apart from the metal tube envelope and wherein said air-cooled means includes means for blowing air through the space between the tube envelope and the tube housing, the tube housing acting as a duct directing the air flow over the surface of the tube envelope for cooling the tube envelope.

7. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying electrical potential to produce x-rays; and (D) a heat transfer sleeve within said evacuated tube envelope extending from the first end wall past the anode, the heat transfer sleeve being spaced-apart from the cylindrical side wall, and the heat transfer sleeve receiving heat emanating from the anode during operation of the tube to produce X-rays and transferring that heat to the first end wall for dispersal, the heat transfer sleeve defining an opening physically and electrically accommodating the cathode, said opening being covered by an auxiliary heat shield, said auxiliary heat shield including a window for passing the beam of X-rays the heat transfer sleeve and cylindrical side wall of the tube envelope including means permitting the passage therethrough of the desired beam of x-rays from within the tube envelope and exteriorally of the tube envelope.

8. An X-ray tube as defined in claim 7 wherein the auxiliary heat shield is fabricated of molybdenum.

9. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode, the heat transfer sleeve being spaced-apart from the cylindrical side wall, the heat transfer sleeve receiving heat emanating from the anode during operation of the tube to produce the beam of X-rays and transferring that heat to the first end wall for dispersal, the heat transfer sleeve and cylindrical side wall being constructed to permit passage of the beam of X-rays; and (E) a cylindrical tube housing surrounding and spaced apart from the metal tube envelope wherein the cylindrical tube housing includes a cylindrical outer wall and a mounting plate extending across the interior thereof, said mounting plate receiving and mounting the first end wall of the tube envelope for receiving heat transferred from the tube envelope.

10. An X-ray tube as defined in claim 9 wherein the tube housing mounting plate has a plurality of fins for dissipating heat transferred from the tube envelope.

11. An X-ray tube as defined in claim 10 wherein the fins are in thermal contact with the cylindrical outer wall which receives heat through the fins for dissipation.

12. An X-ray tube as defined in claim 10 and further comprising:

(F) means for blowing air through the space between the tube envelope and the tube housing, the tube housing acting as a duct directing air flow over the surface of the tube envelope for cooling the tube envelope.

13. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode and having a free end, the heat transfer sleeve being spaced-apart from the cylindrical side wall, the heat transfer sleeve receiving heat emanating from the anode during operation of the tube to produce the beam of X-rays and transferring that heat to the first end wall for dispersal, the heat transfer sleeve and cylindrical side wall being constructed to permit passage of the beam of X-rays; and (E) a heat transfer cross plate secured to the free end of the heat transfer sleeve and extending substantially across the target face of the anode, the heat transfer cross plate receiving heat emanating from the anode during operation of the X-ray tube to produce X-rays, and transferring that heat via the heat transfer sleeve to the first end wall for dispersal; the heat transfer cross plate being notched to physically and electrically accommodate the cathode.

14. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode, and having a free end the heat transfer sleeve being spaced-apart from the cylindrical side wall, and the heat transfer sleeve receiving heat emanating from the anode during operation of the tube to produce the beam X-rays and transferring that heat to the first end wall for dispersal, the heat transfer sleeve and cylindrical side wall being constructed to permit passage of the beam of X-rays; and (E) a heat transfer cross plate secured to the free end of the heat transfer sleeve and extending substantially across the target face of the anode, the heat transfer cross plate receiving heat emanating from the anode during operation of the X-ray tube to produce X-rays, and transferring that heat via the heat transfer sleeve to the first end wall for dispersal; the anode being mounted on a shaft having both of its ends supported on bearings, and the heat transfer cross plate being also notched to accommodate the shaft.

15. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode and having a free end, the heat transfer sleeve being spaced-apart from the cylindrical side wall, and the heat transfer sleeve receiving heat emanating from the anode during operation of the tube to produce the beam of X-rays and transferring that heat to the first end wall for dispersal; the heat transfer sleeve and cylindrical side wall being constructed to permit passage of the beam of X-rays; and (E) a heat transfer cross plate secured to the free end of the heat transfer sleeve and extending substantially across the target face of the anode, the heat transfer cross plate receiving heat emanating from the anode during operation of the X-ray tube to produce the beam of X-rays, and transferring that heat via the heat transfer sleeve to the first end wall for dispersal; the anode being mounted on a shaft having both of its ends supported on bearings, and the heat transfer cross plate being also notched to accommodate the shaft, and further comprising a layer of radiation absorbing material applied to the exterior of the cylindrical side wall and second end wall, except for an area for passing a desired beam of X-rays, the heat transfer sleeve defining an opening physically and electrically accommodating the cathode, said opening being covered by an auxiliary heat shield, said auxiliary heat shield including a window for passing the beam of X-rays.

16. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode and having a free end, the heat transfer sleeve being spaced-apart from the cylindrical side wall, the heat transfer sleeve receiving heat emanating from the anode during operation of the tube to produce X-rays and transferring that heat to the first end wall for dispersal, wherein the heat transfer sleeve defines an opening physically and electrically accommodating the cathode, and said opening is covered by an auxiliary heat shield including a window means for passing a desired beam of x-rays and, (E) the heat transfer sleeve and cylindrical side wall of the tube envelope including means permitting the passage therethrough of the desired beam of X-rays from within the tube envelope and exteriorally of the tube envelope; and (F) a heat transfer cross plate secured to the free end of the heat transfer sleeve and extending substantially across the target face of the anode, the heat transfer cross plate receiving heat emanating from the anode during operation of the X-ray tube to produce X-rays, and transferring that heat via the heat transfer sleeve to the first end wall for dispersal, the heat transfer cross plate being notched to physically and electrically accommodate the cathode.

17. An X-ray tube comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce a beam of x-rays, and conductor means connected to the anode and cathode for applying an electrical potential;

(D) a heat transfer sleeve within said evacuated tube envelope extending from the first end wall past the anode, the heat transfer sleeve being spaced-apart from the cylindrical side wall to provide an annular evacuated space within the vacuum of the evacuated tube envelope, and the heat transfer sleeve receiving heat emanating from the anode during operation of the tube and transferring that heat to the first end wall for dispersal, the heat transfer sleeve and cylindrical side wall being constructed to permit passage of the beam of X-rays produced by the X-ray tube, (E) the heat transfer sleeve and cylindrical side wall of the tube envelope including means permitting the passage therethrough of the beam of X-rays from within the tube envelope and exteriorally of the tube envelope; and F. an off-axis X-ray shield surrounding the beam of X-rays and wherein the heat transfer sleeve defines an opening physically and electrically accommodating the cathode, and said opening is covered by an auxiliary heat shield including a window means for passing a desired beam of x-rays.

18. Apparatus comprising an X-ray tube as defined in claim 2 wherein the conductor means connected to the anode and cathode extend to the exterior of the tube envelope through two insulating members mounted through the second end wall, said apparatus further comprising:

(E) two electrical supply cables for the anode and cathode, respectively, each supply cable having at least one conductor surrounded by an elongated, flexible insulating sheath with the conductor extending from the end thereof and having a connector connected to the conductor; and (F) terminations for attaching the electrical supply cables to the tube envelope, each termination having:

(1) a mass of electrically insulating material:

(a) configured to matingly conform to the insulating member extending through the second end wall;

(b) receiving and holding the end of the electrical supply cable at an angle with respect to the tube envelope such that radiation cannot escape along the electrical supply cable;

(c) receiving and holding the conductor and connector means for connection to the conductive means extending through the insulating members, and (2) radiation absorbing material deployed to block the escape of radiation passing through the insulating members of the second tube wall and the mass of insulation of the terminations.

19. An X-ray tube as defined in claim 18 wherein the radiation absorbing material is lead.

20. An X-ray tube as defined in claim 19 and further comprising:

(G) heat transfer cross plate secured to the free end of the heat transfer sleeve and extending substantially across the target face of the anode, the heat transfer cross plate receiving heat emanating from the anode during operation of the X-ray tube to produce X-rays, and transferring that heat via the heat transfer sleeve to the first end wall for dispersal.

21. An X-ray apparatus comprising:

(A) an evacuated tube envelope fabricated primarily of metal, the tube envelope generally comprising a first end wall, a cylindrical side wall and a second end wall;

(B) an anode rotatably mounted in the tube envelope with its target surface facing the second end wall; and drive means for rotating the anode;

(C) a cathode mounted within the tube envelope and positioned to cooperate with the anode to produce X-rays;

(D) two insulating members extending through the second end wall, and conductive means extending from the anode to the exterior of the tube envelope through one of the insulating members and from the cathode to the exterior of the tube envelope through the other of the insulating members;

(E) two electrical supply cables for the anode and cathode, respectively, each supply cable having at least one conductor surrounded by an elongated, flexible insulating sheath with the conductor extending from the end thereof and having connector means for connecting with the conductive means extending through the insulating members;

(F) terminations for attaching the electrical supply cables to the tube envelope, each termination having:

(1) a shell and a mass of formed electrically insulating compound filling said shell, said compound:

(a) being configured to matingly conform to the insulating member extending through the second end wall;

(b) receiving and holding the end of the electrical supply cable at an angle with respect to the tube envelope such that radiation cannot escape along the electrical supply cable;

(c) receiving and holding the conductor and connector means for connection to the conductive means extending through the insulating members, and (2) radiation absorbing material covering said shell and deployed to block the escape of radiation passing through the insulating members of the second tube wall and the mass of electrically insulating compound of the terminations.

* * * * *